United States Patent [19]

Urfer et al.

[11] Patent Number: 4,780,250

[45] Date of Patent: Oct. 25, 1988

[54] NONIONIC FINE FABRIC DETERGENT COMPOSITIONS

[75] Inventors: Allen D. Urfer; Gail M. Howell, both of Decatur, Ill.

[73] Assignee: Staley Continental, Inc., Rolling Meadows, Ill.

[21] Appl. No.: 924,170

[22] Filed: Oct. 27, 1986

Related U.S. Application Data

[63] Continuation of Ser. No. 781,272, Sep. 26, 1985, abandoned.

[51] Int. Cl.[4] ..... C11D 3/22; C11D 3/42

[52] U.S. Cl. ..... 252/547; 252/174.17; 252/174.21; 252/542; 252/DIG. 1; 252/DIG. 14

[58] Field of Search ..... 252/174.17, 547, 548, 252/527, 528, DIG. 14, DIG. 1, 174.21, 542

[56] References Cited

U.S. PATENT DOCUMENTS 4,446,042 5/1984 Leslie ..... 252/102
4,483,779 11/1984 Llenado et al. ..... 252/135

FOREIGN PATENT DOCUMENTS 57-105495 6/1982 Japan .

*Primary Examiner*—Paul Lieberman
*Assistant Examiner*—John F. McNally
*Attorney, Agent, or Firm*—James B. Guffey; Michael F. Campbell; J. Daniel Wood

[57] ABSTRACT

Substantially builder-free fine fabric detergent compositions are provided which comprise an aqueous solution containing from about 10 to 70 weight percent of a surfactant mixture consisting essentially of a 1:3 to about 10:1 weight ratio combination of a glycoside surfactant and an antistatic amine oxide surfactant.

8 Claims, No Drawings

NONIONIC FINE FABRIC DETERGENT COMPOSITIONS

This application is a continuation of application Ser. No. 781,272 filed Sept. 26, 1985, now abandoned.

BACKGROUND OF THE INVENTION

The present invention relates to aqueous liquid detergent compositions and to the use of same in the laundering of fabric materials in general and, in particular, to the laundering under relatively mild washing conditions of fine fabric materials such as nylon, polyester, wool, silk, and the like.

Alkyl glycoside materials such as, for example, higher alkyl monoglycosides and higher alkyl polyglycosides are known materials; are known, at least in certain circumstances, to function as nonionic surfactants; and have been suggested as being suitable for use in certain specially formulated detergent compositions. See in this regard, for example, Published European patent application Nos. 0070074; 0070075; 0070076; and 0070077, all of which published on Jan. 19, 1983 as well as Published European patent application Nos. 0075994; 0075995; and 0075996 which published on Apr. 6, 1983. See also Published European patent application No. 0105556 (published Apr. 18, 1984) which discloses liquid detergent compositions containing anionic surfactants, alkylpolyglycoside surfactants, selected nonionic surfactants and optionally also containing various other ingredients such as suds stabilizing amine oxide surfactants, detergent builder materials, and the like; Published European patent application No. 0106692 (published Apr. 25, 1984) which discloses stable heavy-duty liquid detergent compositions containing a mixture of an ethoxylated fatty alcohol nonionic surfactant, an alkylpolyglycoside surfactant and a quaternary ammonium cationic surfactant in conjunction with a polyethylene glycol compound and a wide variety of potential conventional laundry detergent additives; and U.S. Pat. No. 4,493,773 (issued Jan. 15, 1985) which discloses laundry detergent compositions which contain a conventional nonionic detergent surfactant, an alkylpolyglycoside detergent surfactant and a quaternary ammonium cationic fabric softening surfactant and which are said to be capable of including a wide variety of conventional laundry detergent additives such as relatively small amounts of detergent builders, detergency cosurfactants such as trialkyl amine oxides, solvents such as ethanol, and the like.

As is reflected within the prior art references noted above, the various glycoside surfactant-containing laundry detergent compositions suggested to date generally involve the use of said glycoside surfactant in combination with various anionic surfactant materials and/or with various conventional non-glycosidic ethoxylated nonionic surfactant materials and/or in conjunction with one or more of a variety of detergent builder ingredients.

SUMMARY OF THE INVENTION

In accordance with the present invention, it has been discovered that certain especially beneficial end-use-specific glycoside surfactant-based detergent compositions can be suitably prepared by properly formulating one or more glycoside surfactants with certain antistatic amine oxide surfactants in the absence of (or at least substantially in the absence of) conventionally employed laundry detergent ingredients such as anionic surfactant ingredients, non-glycosidic ethoxylated nonionic surfactant ingredients and conventional detergent builder materials.

Thus, the present invention, in one of its aspects, is a substantially builder-free fine fabric laundry detergent composition which comprises, on a total composition weight basis:

a. from about 10 to about 70 weight percent of a surfactant component which consists essentially of a combination of a glycoside surfactant and an antistatic amine oxide surfactant, the weight ratio of the glycoside surfactant to the amine oxide surfactant being from about 1:3 to about 10:1; and b. from about 30 to about 90 weight percent water.

Another aspect of the present invention involves the use of the above-described detergent composition in a fabric laundering operation in which said detergent composition is diluted with water to normal laundry usage levels (typically about $\frac{1}{4}$ cup of the above-stated composition in from about 5 to about 15 gallons of wash water) and is then employed to wash or launder soiled clothing or other soiled fabric materials. More specifically stated, this latter embodiment is essentially a process for laundering soiled fabric materials, said process comprising immersing said fabric material, with at least mild agitation, in a substantially builder-free washing medium comprising, on a total washing medium weight basis, from about 200 part per million to about 1250 part per million of a surfactant component consisting essentially of a combination of a glycoside surfactant and an antistatic amine oxide surfactant in a glycoside surfactant to amine oxide surfactant weight ratio of from about 1:3 to about 10:1.

The composition and process of the present invention are especially well suited to and beneficial for the laundering under relatively mild washing conditions (e.g., mild or gentle machine agitation or hand washing and at low or cold wash water temperature) of fine fabric materials such as silk, nylon, polyester and wool.

It is a particularly noteworthy feature or benefit of the present invention that the aforementioned antistatic amine oxide surfactant materials provide, at a given usage level of same, substantially more pronounced or enhanced antistatic control within the subject glycoside surfactant-based formulations than they do in comparable compositions wherein conventional ethoxylated alcohol nonionic surfactants are employed in place of said glycoside surfactant component.

DETAILED DESCRIPTION OF THE INVENTION

Glycoside surfactants suitable for use in the practice of the present invention include those of the formula:

$$RO(R'O)_y(Z)_x A$$

wherein R is a monovalent organic radical (e.g., a monovalent saturated aliphatic, unsaturated aliphatic or aromatic radical such as alkyl, hydroxyalkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to about 18 and more preferably from about 9 to about 13) carbon atoms; R′ is a divalent hydrocarbon radical containing from 2 to about 4 carbon atoms such as ethylene, propylene or butylene (most preferably the unit $(R'O)_y$ represents repeating units of ethylene oxide, propylene oxide and/or random or block combinations thereof); y is a number having an average value of from 0 to about 12; Z represents a moiety derived from a reducing saccharide containing 5 or 6 carbon atoms (most preferably a glucose unit); and x is a number having an average value of from 1 to about 10 (preferably from 1.5 to about 10 and more preferably from about 1.5 to about 5).

Glycoside surfactants of the sort mentioned above, and various preferred subgenera thereof, are described in U.S. Pat. No. 4,483,779 to Llenado et al (issued Nov. 20, 1984) the discussion and description of which is hereby incorporated by reference.

Glycoside surfactants suitable for use herein also include those of the Formula A above in which one or more of the normally free (i.e., unreacted hydroxyl groups of the saccharide moiety, Z, have been alkoxylated (preferably, ethoxylated or propoxylated) so as to attach one or more pendant alkoxy or poly (alkoxy) groups in place thereof. In such event, the amount of alkylene oxide (e.g., ethylene oxide, propylene oxide, etc.) employed will typically range from abut 1 to about 20 (preferably from about 3 to about 10) moles thereof per mole of saccharide moiety within the Formula A glycoside material.

In glycosides of the Formula A above, the $RO(R^1O)_y$ groups is generally bonded or attached to the number 1 carbon atom of the saccharide moiety, Z. Accordingly, the free hydroxyls available for alkoxylation are typically those in the number 2, 3, 4 and 6 positions in 6-carbon atom saccharides and those in the number 2, 3 and 4 positions in 5-carbon atom saccharide species. Typically, the number 2 position hydroxyls in 5-carbon saccharides, and the number 2 and 6 position hydroxyls in 6-carbon saccharides, are substantially more reactive or susceptible to alkoxylation than those in the number 3 and 4 positions. Accordingly, alkoxylation will usually occur in the former locations in preference to the latter. Examples of the indicated alkoxylated glycoside materials, and of methodology suitable for the preparation of same, are described in U.S. patent application Ser. No. 06/704,828 filed Feb. 22, 1985 by Roth et al.

Glycoside surfactants especially preferred for use herein include those of the Formula A above wherein R is an alkyl group containing from about 8 to 18 (especially from about 9 to about 13) carbon atoms; y is zero; Z is glucose or a moiety derived therefrom; and x has an average value of from 1.5 to about 5 (especially from about 1.5 to about 3).

Glycoside surfactants of particular interest for use in the practice of the present invention preferably have a hydrophilic-lipophilic balance (HLB) in the range of from about 10 to about 18 and most preferably in the range of from about 12 to about 14.

Amine oxide surfactants suitable for use herein include:

(1) Higher alkyl or alkenyl di (lower alkyl) amine oxides in which the higher alkyl or alkenyl group is either branched or straight chain and contains from about 8 to about 22 (preferably from about 12 to about 18 and more preferably from about 16 to about 18) carbon atoms and in which the lower alkyl group contains from 1 to about 6 carbon atoms and is preferably methyl or ethyl. Exemplary of such amine oxides are lauryl dimethyl amine oxide; myristyl dimethyl amine oxide; stearyl dimethyl amine oxide; mixed long chain amine oxides such as lauryl/myristyl dimethyl amine oxide, dimethyl cocoamine oxide, dimethyl (hydrogenated tallow) amine oxide, myristyl/palmityl dimethyl amine oxide, etc.; and the like.

(2) Higher alkyl or alkenyl di (hydroxy lower alkyl) amine oxides in which the higher alkyl or alkenyl group contains from about 8 to about 22 (preferably from about 12 to about 18 and more preferably from about 16 to about 18) carbon atoms and wherein the hydroxy lower alkyl group is preferably 2-hydroxyethyl such as for example, bis(2-hydroxyethyl) cocoamine oxide; bis(2-hydroxyethyl) tallowamine oxide; bis(2-hydroxyethyl) stearylamine oxide; and the like.

(3) Higher alkyl or alkenyl amidopropyl di (lower alkyl) amine oxides in which the higher alkyl or alkenyl group has about 8–22 (preferably about 12–18 and more preferably about 16–18 carbon atoms and can be straight or branched chain and wherein the lower alkyl groups are preferably methyl or ethyl. Examples of these latter compounds include cocamidopropyl dimethyl amine oxide and tallowamidopropyl dimethyl amine oxide.

(4) Higher alkyl or alkenyl morpholine oxides in which the higher alkyl or alkenyl group has from about 8–22 (preferably from about 12 to about 18 and more preferably about 16–18) carbon atoms and is either branched or straight chain.

An especially preferred antistatic amine oxide surfactant for use herein is stearyl dimethyl amine oxide.

The total amount of surfactant ingredient employed in the compositions hereof is typically in the range of from about 10 to about 70 (preferably from about 15 to about 40 and most preferably from about 15 to about 30) weight percent on a total composition weight basis. Further (and has been noted above), said surfactant ingredient consists essentially of a combination of a glycoside surfactant and an antistatic amine oxide surfactant in a glycoside to amine oxide weight ratio of from about 1:3 to about 10:1. Said ratio is preferably from about 3:1 to about 10:1 and is more preferably from about 3:1 to about 6:1.

The water content of the subject detergent compositions is typically from about 30 to about 90 weight percent and is preferably from about 60 to about 85 (and most preferably from about 70 to about 85) weight percent, said ranges all being stated on a total composition weight basis.

As has also been mentioned above, the compositions hereof are typically employed in actual laundering operations by diluting approximately a quarter cup of same with from 5 to 15 gallons of wash water and using same in such diluted form to launder clothing or other textile fabric articles in the usual fashion. The surfactant ingredient concentration within the diluted wash water is typically from about 200 to about 1250 ppm on a total wash water weight basis.

The manner in which the detergent compositions hereof are prepared or formulated is not particularly critical and such can be readily accomplished in any convenient fashion as may be desired in a given instance. Oftentimes, however, the aforementioned glycoside and amine oxide surfactant ingredients are conveniently prepared, purchased or otherwise obtained in the form of relatively concentrated (e.g., 40 to 80 weight percent active) aqueous solutions of same and it is therefore generally convenient to admix them together (in the desired active ingredient ratios or proportion) in that form and to thereafter dilute the resulting mixture (if and when necessary or desired) with water to the desired total active surfactant ingredient content.

In addition to the above specified surfactant ingredients and water, the composition can optionally (and frequently will desirably) contain relatively minor amounts, typically less than about 5 (more typically less than about 2 and most typically less than about 1) weight percent (total composition weight basis) of the usual types of non-builder, non-surfactant auxiliary ingredients as are commonly or customarily employed in conventional laundry detergent compositions such as, for example, perfumes; optical brighteners; pearlescing agents; colorants; viscosifying agents; and the like. Further, it should also be noted that while the compositions hereof are desirably "substantially free" of detergency builder ingredients, it is nonetheless contemplated that relatively minor amounts (e.g., less than about 10, preferably less than about 5 and most preferably less than about 2, weight percent on a total composition weight basis) of builder ingredients such as alkali metal salts of citrates, phosphates, carbonates and the like can nonetheless be included therein without deviating or departing from the spirit or scope of the instantly claimed invention.

The present invention is further illustrated and understood by reference to the following working examples in which all parts and percentages are on a weight basis unless otherwise indicated.

EXAMPLES 1 and 2

In these examples, a series of fine fabric detergent compositions are prepared by dissolving a $C_{12-13}$ alkyl polyglucoside surfactant having a degree of polymerization of about 2.5 (APG 23-3) and an amine oxide surfactant, specifically stearyl dimethyl amine oxide, in water and the resulting compositions are then evaluated for cleaning and/or static control effectiveness in the laundering of wool, polyester and nylon fabric materials.

In these examples, the total surfactant ingredient content of the compositions prepared and tested is about 20 weight percent on a total composition weight basis and the APG:amine oxide ratio employed therein is as shown in Table A below.

For comparative purposes, experimental formulations are also prepared and evaluated in which there is employed as the surfactant ingredient: the APG alone; a linear alkyl ethoxylate (LAE) alone (i.e., an ethoxylated $C_{12-15}$ fatty alcohol, 7 moles ethylene oxide per mole fatty alcohol); and the LAE in combination with the amine oxide.

The results of the cleaning and static control evaluations for these various formulations are summarized in Table A below.

In obtaining these evaluation results, the cleaning effectiveness is determined with a Tergotometer apparatus using a 10 minute wash cycle at a water temperature of 85° F. (29.4° C.) a water hardness of 120 ppm and an agitator speed of 75 rpm. The static electricity build-up is quantitatively determined using a Simco Electrostatic Locator, Model SS2 and is qualitatively evaluated by observing the degree of "static cling" exhibited by the laundered fabric upon removal from the dryer.

TABLE A

| Example Number | Surfactant Ingredient[1,2,3] | Usage Level[4] (ppm) | Cleaning Performance | | | Static Charge Build up (Volts) | | Degree of Static Cling[5] |
|---|---|---|---|---|---|---|---|---|
| | | | Wool | Nylon | Polyester | Nylon | Polyester | |
| 1 | 3:1 weight ratio of APG 23-3:Amine Oxide | 700 | Good | Good | Fair | 4,500 | 100 | Very Low |
| 2 | 6:1 weight ratio of APG 23-3:Amine Oxide | 700 | N.D.[6] | N.D. | N.D. | 5,600 | 100 | Very Low |
| Control 1 | APG 23-3 Alone | 700 | Good | Good | Fair | 14,000 | 10,000 | Moderate to high |
| Control 2 | LAE Alone | 700 | Good | Good | Fair | 10,000 | 15,000 | High |
| Control 3 | 3:1 weight ratio of LAE:Amine Oxide | 700 | Good | Good | Fair | 5,000 | 3,000 | Moderate |

[1]APG 23-3 = $C_{12-13}$ alkyl polyglucoside having an average degree of polymerization (D.P.) of about 2.5.
[2]Amine Oxide - stearyl dimethyl amine oxide.
[3]LAE = An ethoxylated $C_{12-15}$ fatty alcohol (7 moles ethylene oxide per mole of fatty alcohol).
[4]Parts by weight of active surfactant per million parts by weight of wash water.
[5]Mixed Polyester and Nylon dryer load.
[6]N.D. = Not determined.

As can be seen from the results in Table A (i.e., comparing Example 1 with Control 3), the antistatic amine oxide surfactant provides notably better static control when used in conjunction with the glucoside surfactant than it does when used with the conventional ethoxylated alcohol nonionic surfactant material.

EXAMPLE 3

The procedure of Examples 1 and 2 is repeated using lauryl dimethyl amine oxide in place of the stearyl dimethyl amine oxide. Upon evaluating the antistatic effectiveness at various APG:amine oxide ratios, it is found that the lauryl dimethyl amine oxide needs to be employed at an amine oxide:APG weight ratio in excess of 1:1 (more specifically at a ratio of about 2:1) in order to achieve substantial or acceptable antistatic effectiveness.

While the present invention has been described and illustrated by reference to certain representative examples and embodiments thereof, such is not to be interpreted as in any way limiting the scope of the instantly claimed invention.

We claim:

1. A substantially builder-free fine fabric laundry detergent composition which comprises, on a total composition weight basis:

a. from about 10 to about 70 weight percent of a surfactant component which consists of a combination of a glycoside surfactant and an antistatic amine oxide surfactant, the weight ratio of the glycoside surfactant to the amine oxide surfactant being from about 3:1 to about 10:1, said glycoside surfactant corresponding to the formula:

$$RO(R^1O)y(Z)_x A$$

wherein R is a monovalent organic radical containing from about 6 to about 30 carbon atoms; O is an oxygen atom; $R^1$ is a divalent hydrocarbon radical containing from 2 to about 4 carbon atoms; y is a number having an average value of from 0 to about 12; Z represents a moiety derived from a reducing saccharide containing 5 or 6 carbon atoms; and x is a number having an average value of from 1 to about 10 and said amine oxide surfactant being selected from the group consisting of $C_{16}$–$C_{18}$ alkyl or alkenyl di (lower alkyl) amine oxides; $C_{16}$–$C_{18}$ alkyl or alkenyl di (hydroxy lower alkyl) amine oxides; $C_{16}$–$C_{18}$ alkyl or alkenyl amidopropyl di (lower alkyl) amine oxides and $C_{16}$–$C_{18}$ alkyl or alkenyl morpholine oxides; and b. from about 30 to about 90 weight percent water.

2. The detergent composition of claim 1 wherein, in the Formula A glycoside surfactant, R is a monovalent organic radical of from about 8 to about 18 carbon atoms; y is zero; Z is glucose or a moiety derived therefrom; and x is a number having an average value of from about 1.5 to about 5.

3. The detergent composition of claim 2 wherein, the antistatic amine oxide surfactant is stearyl dimethyl amine oxide.

4. The detergent composition of claim 3 wherein the weight ratio of the glycoside surfactant to the amine oxide surfactant is from about 3:1 to about 6:1.

5. The detergent composition of claim 1 wherein the weight ratio of the glycoside surfactant to the amine oxide surfactant is from about 3:1 to about 6:1.

6. The detergent composition of claim 5 wherein the surfactant component constitutes from about 15 to about 40 weight percent of said composition on a total weight basis.

7. A process for laundering soiled fabric materials, said process comprising immersing said fabric material, with at least mild agitation, in a substantially builder-free washing medium comprising, on a total washing medium weight basis, from about 200 part per million to about 1,250 part per million of a surfactant component consisting of a combination of a glycoside surfactant and an antistatic amine oxide surfactant in a glycoside surfactant to amine oxide surfactant weight ratio of from about 3:1 to about 10:1, said glycoside surfactant corresponding to the formula:

$$RO(R^1O)_y(Z)_x A$$

wherein R is a monovalent organic radical containing from about 6 to about 30 carbon atoms; O is an oxygen atom; $R^1$ is a divalent hydrocarbon radical containing from 2 to about 4 carbon atoms; y is a number having an average value of from 0 to about 12; Z represents a moiety derived from a reducing saccharide containing 5 or 6 carbon atoms; and x is a number having an average value of from 1 to about 10 and said amine oxide surfactant being selected from the group consisting of $C_{16}$–$C_{18}$ alkyl or alkenyl di (lower alkyl) amine oxides; $C_{16}$–$C_{18}$ alkyl or alkenyl di (hydroxyl lower alkyl) amine oxides; $C_{16}$–$C_{18}$ alkyl or alkenyl amidopropyl di (lower alkyl) amine oxides and $C_{16}$–$C_{18}$ alkyl or alkenyl morpholine oxides.

8. The process of claim 7 wherein fabric material laundered thereby is a silk, nylon, polyester or wool fabric material.

* * * * *